United States Patent [19]

Schwartz

[11] 4,454,631

[45] Jun. 19, 1984

[54] IMPROVED SAFETY BAR CUTOFF AND BRAKE METHOD

[75] Inventor: Robert C. Schwartz, Lubbock, Tex.

[73] Assignee: Horn and Gladden Lint Cleaner Co., Inc., Lubbock, Tex.

[21] Appl. No.: 495,675

[22] Filed: May 18, 1983

Related U.S. Application Data

[62] Division of Ser. No. 310,109, Oct. 9, 1981, Pat. No. 4,416,035.

[51] Int. Cl.[3] ..... D01G 31/00

[52] U.S. Cl. ..... 19/0.2; 19/202

[58] Field of Search ..... 19/0.2, 0.22, 39, 48 R, 19/202, 203; 74/608, 609, 612, 613, 616; 192/133, 129 R, 144, 148; 139/1 E, 336

[56] References Cited

U.S. PATENT DOCUMENTS

| | | | |
|---|---|---|---|
| 3,373,773 | 3/1968 | Balentine et al. | 139/1 E |
| 3,498,217 | 3/1970 | Kletti | 101/216 |
| 3,877,111 | 4/1975 | Horn | 19/202 |
| 4,041,765 | 8/1977 | Kemper | 72/389 |
| 4,282,963 | 8/1981 | Kafura | 192/133 |

*Primary Examiner*—Louis Rimrodt
*Attorney, Agent, or Firm*—Wendell Coffee

[57] ABSTRACT

An emergency actuator bar extends across an opening in the housing of a lint cleaner in a cotton gin. Actuator arms which hold the bar also normally hold a trip plate in the run position. However, a workman striking the emergency bar will remove a sear on one of the actuator arms from the trip plate to permit a spring to snap the trip plate into a stop position. When the trip plate moves to the stop position, it disconnects electrical power to a motor driving the machine. The trip plate movement also applies a brake which stops the machine.

2 Claims, 5 Drawing Figures

IMPROVED SAFETY BAR CUTOFF AND BRAKE METHOD

CROSS REFERENCE TO RELATED APPLICATIONS

This is a division of my application Ser. No. 310,109, filed Oct. 9, 1981, now U.S. Pat. No. 4,416,035, granted Nov. 22, 1983.

BACKGROUND OF THE INVENTION

1. Field of the Invention

This invention relates to lint cleaners and more particularly to an emergency safety bar and brake for a lint cleaner.

2. Description of the Prior Art

Lint cleaners are well-known machines for cotton gins. For example, see JAMES L. HORN'S U.S. Pat. No. 3,877,111 for a lint cleaner.

Typically, these machines will have a large diameter condenser drum upon which lint cotton in an air stream is impinged. A batt is formed upon the drum which is doffed by doffing rollers. From the doffing rollers, the batt is fed through directional rollers to a saw cylinder where the cleaning process occurs.

It is customary to have an opening for inspection and maintenance operations at the point where the batt moves from the doffing rollers to the directional rollers. Because of the nature of the process, workmen will often open an access door over the opening to inspect, maintain, and clean the machine while the machine is in full operation. Obviously, it is possible to get the hand engaged with the rollers, which can result in serious injury. The initial engagement is normally not serious, but if the hand is drawn with the batt deep into the machine, serious injury will result.

SUMMARY OF THE INVENTION

New and Different Function

I have intended an emergency safety bar and brake to stop the machine quickly upon tripping the stop. Interviews with persons who have been caught in this type machinery say that normally the placement of the safety bar is not critical inasmuch as people, caught in machinery will be pushing against everything on the front of the machine trying to pull away from it. This is an instinctive action and not a pre-planned action. With this particular machinery, there is time between the instant that a workman is caught and before serious injury occurs to stop the machine, if it is stopped very quickly. Therefore, my invention does two things: (1) immediately cuts the electric power to the motor driving the rolls, and (2) applies a brake to transmission elements which transmit the power from the motor to the feed rolls, inasmuch as there is considerable momentum to the moving elements. Therefore, it is possible to stop the machine before serious injury is done to the workman.

Thus, it may be seen that the total function of the safety stop and brake far exceeds the sum of the function of the individual elements such as springs, pitmans, levers, etc.

Objects of this Invention

An object of this invention is to prevent injuries to workmen.

Other objects are to achieve the above which a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWING

FIG. 3 is a side elevational view thereof.

DESCRIPTION OF THE PREFERRED EMBODIMENT

Figure 1:
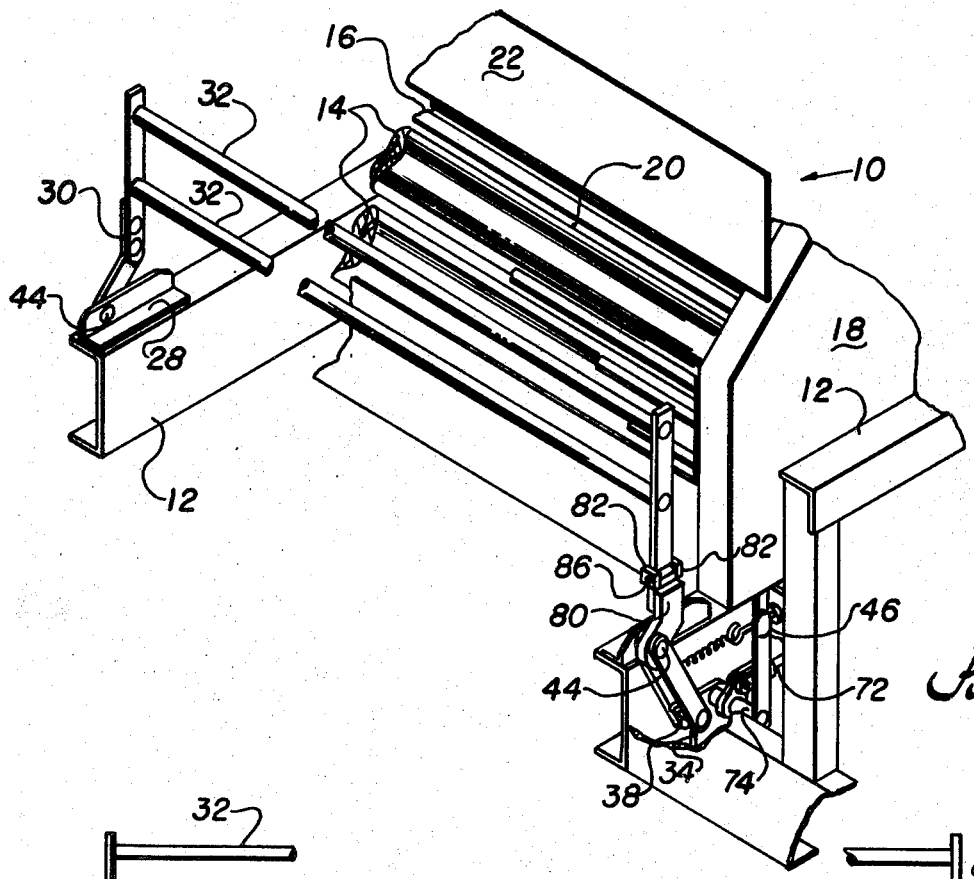
FIG. 1 is a perspective view of my invention mounted upon a lint cleaner with only a portion of the lint cleaner shown.
Figure 2:
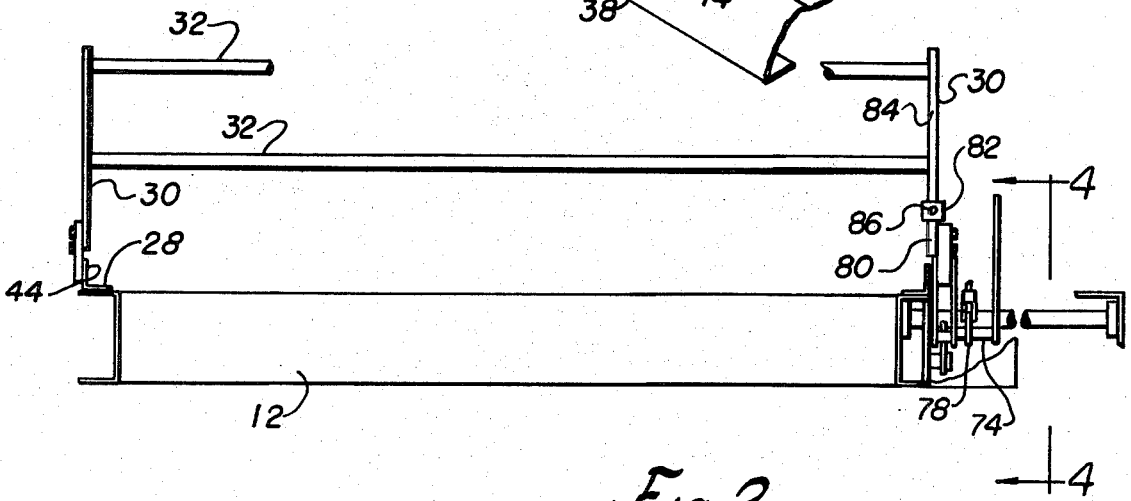
FIG. 2 is a front elevational view thereof.
Figures 4, 5:
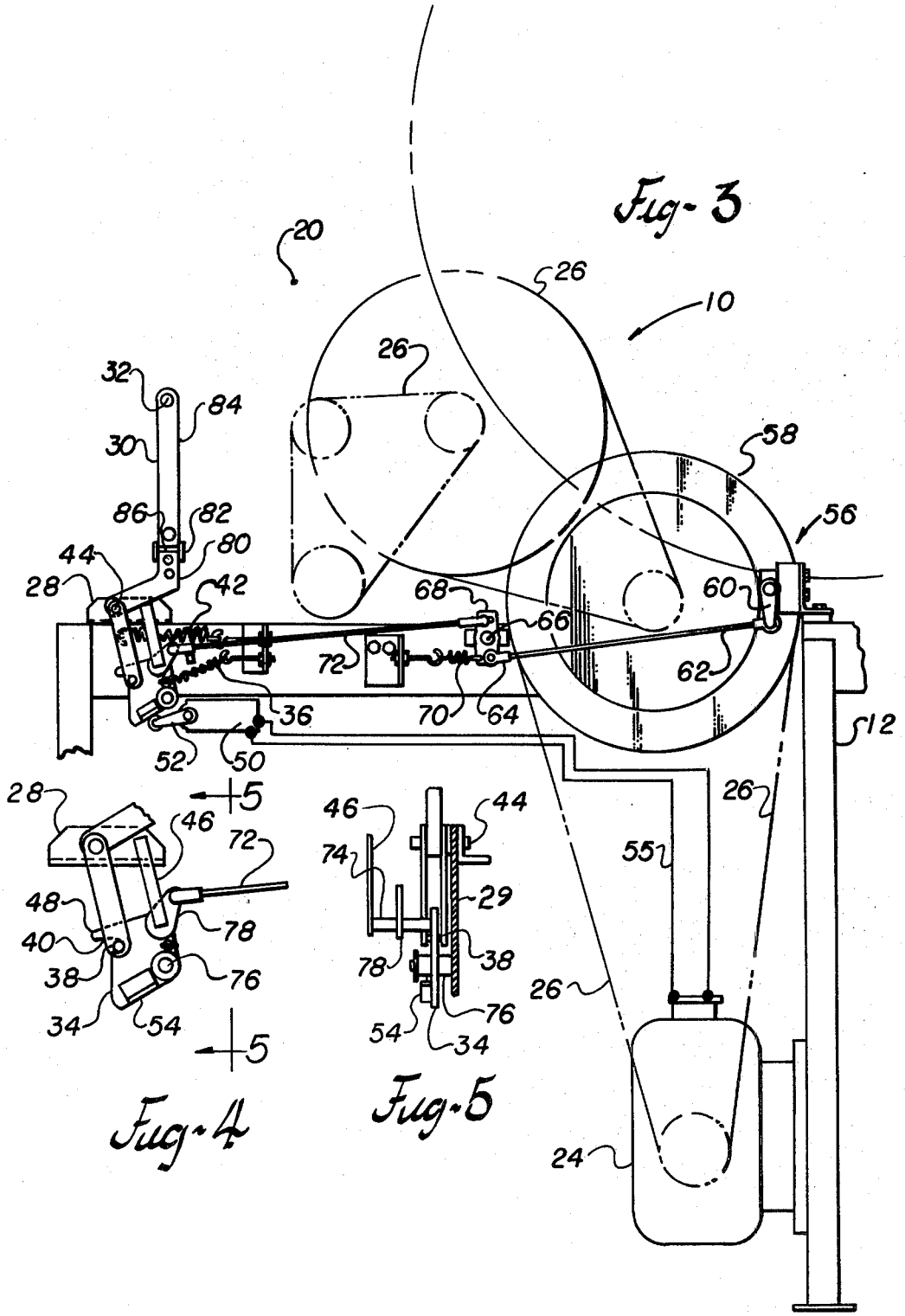
FIG. 4 is a side elevational view of a portion thereof, showing details of construction.
FIG. 5 is a section view taken substantially on line 5—5 showing details of construction.

Referring particularly to the drawing there may be seen illustrated a lint cleaner 10. The lint cleaner has frame 12 having two sides. The frame supports the various bearings which in turn supports feed rollers 14 as well as doffing roller 16. Also supported by the frame is the saw cylinder which is not shown in the drawing. The feed roller 14, doffing roller 16, and saw cylinder are all journaled by bearings for rotation. The cylinders or rollers extend from one side of the frame to the other with each roller being journaled to a bearing mounted on one side of the frame and journaled in another bearing mounted on the other side of the frame.

Generally the lint cleaner 10 would be found in a cotton gin. However, it is of the general category of textile equipment. Textile mills have equipment having feed rollers quite similar to feed rollers 14.

Housing 18 covers the rotating rollers within the machine. Opening 20 in the housing 18 is adjacent to the feed rollers 14 and doffing roller 16. Access door 22 partially covers the opening 20, when closed.

Electric motor 24 is mounted upon the frame 12 at one end. It is connected by transmission means 26 to the rollers for revolving the rollers.

Those having ordinary skill in the textile machinery arts will recognize that the specific description of the lint cleaner to this point, is conventional and commercially available on the market.

According to my invention actuator arm 30 is pivoted to the frame 12 on each side of the frame. At least one actuator bar 32 extends from the actuator 30 on one side of the machine to the actuator arm 30 on the other side of the machine. As may be seen in the drawing, actually two actuator bars are used, however, according to the particular design, either one bar could be used particularly if it were much wider than the circular bar as shown. According to the present design and drawings, the bars are shown in front of the opening 20. However, as discussed above, it is not necessary that they be directly in front of the opening 20, but merely at the opening.

Trip plate 34 is pivoted to the one side of the frame 12. As a detail of construction, the trip plate 34 is pivoted by shaft 76 to mounting plate 29 which depends from angle member 28. The axis of the pivot (shaft 76) of the trip plate 34 is parallel to the axis of the pivot 44 of the arms 30. The trip plate 34 will have two positions. One being a run position and the other being a stop position. Helical tension trip spring 36 is attached between the trip plate 34 and frame 12. The trip spring 36 biases the trip plate 34 to the stop position.

One of the actuator arms 30 extends downward to adjacent the trip plate 34 and has sear 38 thereon. The sear 38 fits within notch 40 upon the trip plate 34 when the trip plate is in the run position. Helical tension actuator spring 42 is attached between the actuator arm 30 and the frame 12. It holds or biases the sear 38 into the notch 40. It may be seen in the drawings according to present design that the pivot point 44 of the actuator arm 30 is between the actuator bar 32 and the sear 38. The pivot point 44 is between the arm 30 and angle member 28 which is attached, as by welding, to frame 12. Also, it may be seen that the sear 38 is outboard of the trip plate 34 and that the actuator bars 32 are outboard of the opening 20. Therefore, when the bars 32 are pushed inward toward the rollers 14 and 16 (as would be the normal reaction of a workman if his hand or clothing were caught within the rollers) the sear 38 will be removed from notch 40 allowing the trip spring 36 to rotate the trip plate 34 to the stop position.

It may be seen that the drawings are drawn with the trip plate 34 in the run position and that the trip plate will rotate clock-wise as seen in the drawings to the stop position. After the trip plate 34 is in the stop position, it can be reset by rotating it back to the run position by reset lever 46 attached to the trip plate 34. It may be seen that above the notch 40 there is located a reset finger 48 to catch the sear 38 when the trip plate 34 is being reset to the run position.

Electric switch 50 having switch arm 52 thereon is attached to the frame 12 adjacent to the trip plate 34. When the trip plate 34 is in run position, switch flange 54 upon the trip plate bears against the switch arm 52 which maintains the switch in run position. The switch 50 is connected by electric wires 55 to the electric motor 24 so that if the switch arm 52 is not depressed by the trip plate 34 through the flange 54 the motor is in an inoperative condition and will be stopped. I.e., when the trip plate 34 rotates to the stop position, the electric motor 24 will be stopped.

A brake assembly, including a caliper-type disc brake 56 is mounted upon the frame 12. As seen in the drawing, the actuator arms 30 and the trip plate 34 are pivoted to the frame 12 near the front of the frame while the disc brake 56 is located near the rear of the frame. The disc brake 56 acts upon disc 58 which is attached to one of the rotatable portions of the transmission means 26 whereby the rollers 14 and 16 are rotated. The disc brake 56 includes brake arm 60 which actuates the brake. As seen in the drawing, when the brake arm 60 is rotated clockwise, it will apply the brake. Brake pitman 62 extends from the brake arm 60 to depending rocker arm 64 upon rocker shaft 66. Brake pitman 62, arm 64 and rocker shaft 66 are all portions of the brake assembly as is upright rocker arm 68.

Helical tension brake spring 70 extends from the depending rocker arm 64 to the frame 12. As may be seen in the drawing the brake spring 70 will bias the brake to the brake positions. I.e., unless the depending rocker arm 64 is not held in the run position, the brake spring 70 will pull the brake pitman 62 so as to rotate the brake arm 60 in a clockwise direction, thus applying the disc brake 56 to the transmission means 26. When the trip plate 24 is in the run poisition, trip pitman 72 extending from the trip plate 34 to the upright arm 68 will hold the rocker arm 64 and 68 in the run position.

As a detail of construction, the reset lever 46 is not attached directly to the trip plate 34 but is attached to a to shaft 74 extending outward from the trip plate. The shaft 74 is mounted above trip plate pivot shaft 76. The trip pitman 72 is attached to ear 78 also mounted on this reset lever shaft 74. Also as a matter of construction, the depending arm 64 and upright arm 68 are not in the same plane but are spaced from one another along the rocker shaft 66 as to properly space these pitmans for proper actuation. Thus the transmission is mechanically braked and the brake is mechanically responsive to the snapping of the trip plate.

It may be seen that this unit is adapted to be added to existing units. When angle member 28 is welded to frame 12, the trip plate assembly is attached to one side of the machine. The rocker shaft 66 together with the disc brake 56 and the disc 58 are readily attached to existing machines. Then the actuator arms 30 are pivoted on each side of the machine by the actuator pivot point or pivot shaft 44 on angle member 28. Difficulty has been experienced in some cases in getting the actuator pivot shafts 44 precisely aligned so that the actuator arms 30 rotate smoothly and freely. It has been found that if a hinge is placed in the actuator arm above the actuator pivot point, or pivot shaft 44 and below the actuator bar 32 that it works more freely. Therefore, the actuator bar on one side has two parts: a lower part 80 having ears 82 welded thereto, and an upper actuator arm 84 having shaft 86 welded thereto. Therefore, by having this articulation in the arm, it is found that the arms pivot upon their pivot shafts 44 more freely, even if the angle 28 are not exactly aligned by highly skilled craftsmen.

Thus it may be seen that in operation, a workman, who in natural reaction, pushes against the bars 32, will release the trip plate 34 which will stop the motor 24 and apply the brake to the transmission means 26. This will stop the rotation of the feed rollers 14 before his hand can be pulled by the feed rollers deeply into the machine, thus preventing major, serious injury to the workman. The saw cylinder and doffing brush of the lint cleaner rotate at a much higher velocity than the feed rollers and have much greater momentum. However, the saw and brush are driven by a separate motor and not braked. Therefore, the brake 56 stops only the rollers, a portion of the moving elements of the machine. The saw cylinder motor is also electrically disconnected by switch 50 to indicate trouble and can be reset to start again only by the lever 46 at the machine.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided.

| | | | |
|---|---|---|---|
| 10 | lint cleaner | 50 | electric switch |

-continued

| | | | |
|---|---|---|---|
| 12 | frame | 52 | switch arm |
| 14 | feed roller | 54 | switch flange |
| 16 | doffing roller | 55 | electric wires |
| 18 | housing | 56 | disc brake |
| 20 | opening | 58 | disc |
| 22 | access door | 60 | brake arm |
| 24 | electric motor | 62 | brake pitman |
| 26 | transmission means | 64 | depending rocker arm |
| 28 | angle member | 66 | rocker shaft |
| 29 | mounting plate | 68 | upright rocker arm |
| 30 | actuator arm | 70 | brake spring |
| 32 | actuator bar | 72 | trip pitman |
| 34 | trip plate | 74 | shaft, reset lever |
| 36 | trip spring | 76 | trip plate pivot shaft |
| 38 | sear | 78 | ear |
| 40 | notch | 80 | lower actuator arm |
| 42 | actuator spring | 82 | ears |
| 44 | actuator pivot point | 84 | upper actuator arm |
| 46 | reset lever | 86 | shaft |
| 48 | reset finger | | |

What is claimed is:

1. The process involving a machine, said machine having:

a frame having two sides, b. a cylinder journaled to the frame revolving at high speed, c. a plurality of rollers revolving at a lower speed than the cylinder journaled to the frame, d. a roller electric motor for revolving the rollers on the frame, e. transmission means connecting the rollers and roller motor, f. a cylinder motor connected to the cylinder, g. a housing on the frame over the cylinder and rollers, and, h. an opening in the housing over the rollers;

wherein the improved method comprises:

i. placing bars extending across the machine at the opening, j. holding a trip plate in a run position by a sear on an arm holding the bars, k. snapping the trip plate to a stop position by a spring when the sear is moved by a workman pushing on the bars, l. stopping the roller electric motor responsive to snapping the trip plate to the stop position, and m. mechanically braking the transmission means mechanically responsive to snapping the trip plate to the stop position.

2. The process of safely operating machinery including:

a. revolving a cylinder at high speed from a cylinder motor, and b. transmitting power from a roller electric motor to rollers thereby c. revolving the rollers at a lower speed than the cylinder, wherein the improved safety method comprises:

d. placing bars across the machine at the rollers, e. cutting the electric power to the roller electric motor responsive to a workman pushing on the bars, and f. snapping a trip plate to a stop position by a spring responsive to a workman pushing on the bars, g. mechanically braking the transmitting of power to the rollers by h. mechanically moving a brake by the trip plate, while i. continuing to revolve the cylinder at high speed.

* * * * *